US009502842B2

(12) United States Patent
Belopolsky et al.

(10) Patent No.: US 9,502,842 B2
(45) Date of Patent: Nov. 22, 2016

(54) NETWORK INTERFACE CONNECTOR WITH PROXIMITY COMPENSATION

(71) Applicant: Bel Fuse (Macao Commercial Offshore) Ltd., Andar H-J (MO)

(72) Inventors: Yakov Belopolsky, Harrisburg, PA (US); David Henry Gutter, Felton, PA (US); Richard D. Marowsky, York, PA (US); Mark Ellis, York, PA (US)

(73) Assignee: Bel Fuse (Macao Commercial Offshore) Ltd. (MO)

( * ) Notice: Subject to any disclaimer, the term of this patent is extended or adjusted under 35 U.S.C. 154(b) by 0 days.

(21) Appl. No.: 14/729,233

(22) Filed: Jun. 3, 2015

(65) Prior Publication Data

US 2016/0020567 A1 Jan. 21, 2016

Related U.S. Application Data

(60) Provisional application No. 62/008,013, filed on Jun. 5, 2014.

(51) Int. Cl.

| | |
|---|---|
| ***H01R 24/00*** | (2011.01) |
| ***H01R 24/64*** | (2011.01) |
| ***H01R 13/6473*** | (2011.01) |
| *H01R 13/66* | (2006.01) |
| *H01R 107/00* | (2006.01) |

(52) U.S. Cl.

CPC ..... *H01R 24/64* (2013.01); *H01R 13/6473* (2013.01); *H01R 13/665* (2013.01); *H01R 2107/00* (2013.01)

(58) Field of Classification Search

CPC ..... H01R 13/6464; H01R 13/6658; H01R 13/6466; H01R 9/2425; H01R 9/2433

USPC ..... 439/676, 620.17, 620.18, 620.21, 439/620.22, 620.23, 941

See application file for complete search history.

(56) References Cited

U.S. PATENT DOCUMENTS

| | | | | |
|---|---|---|---|---|
| 5,587,884 | A * | 12/1996 | Raman | H01R 13/665 333/182 |
| 5,975,960 | A | 11/1999 | Fogg et al. | |
| 6,139,368 | A * | 10/2000 | Bogese, II | H01R 13/7195 439/620.09 |
| 6,171,151 | B1 * | 1/2001 | Lu | H01F 27/027 439/620.23 |
| 6,964,587 | B2 | 11/2005 | Colantuono et al. | |
| 7,166,000 | B2 * | 1/2007 | Pharney | H01R 13/6658 439/676 |
| 7,179,131 | B2 | 2/2007 | Caveney et al. | |
| 7,658,648 | B2 | 2/2010 | Aekins et al. | |
| 7,824,231 | B2 * | 11/2010 | Marti | H01R 13/6466 439/676 |
| 8,128,432 | B2 | 3/2012 | Jaouen et al. | |

(Continued)

OTHER PUBLICATIONS

International Search Report, USPTO, issued in PCT/US2015/033903, Aug. 26, 2015.

*Primary Examiner* — Hae Moon Hyeon

(74) *Attorney, Agent, or Firm* — Patterson Intellectual Property Law, P.C.; Mark J. Patterson; Gary L. Montle

(57) ABSTRACT

A network interface connector includes a plurality of first and second alternating elongate contacts having contact portions situated in a common plane. The first and second contacts have rearward portions situated in respective first and second spaced parallel planes defining a proximity gap between them. A proximity insert having a particular electrical construction suited for a particular application is situated, preferably in a replaceable manner, in the proximity gap to provide the connector with desired transmission properties.

25 Claims, 17 Drawing Sheets

(56) References Cited

U.S. PATENT DOCUMENTS

2008/0254685 A1* 10/2008 Murr ..... H01R 13/6474
439/676

2010/0130069 A1* 5/2010 Fyne ..... H01R 13/6471
439/676

2011/0136382 A1* 6/2011 Jaouen ..... H01R 13/6464
439/620.01

* cited by examiner

Forward NEXT with insert 6a

Forward NEXT with insert 6b

Very significant differences in the electrical response – Forward NEXT with the same connector tested with inserts 6a and 6b

NETWORK INTERFACE CONNECTOR WITH PROXIMITY COMPENSATION

Reference is made to U.S. provisional patent application Ser. No. 62/008,013 filed Jun. 5, 2014, the filing date of which is hereby claimed.

BACKGROUND OF THE INVENTION

Network interface connectors are components of networking active equipment such as routers, switches, controllers and network interface cards. Only the mateable interface geometry proper of these connectors is covered by the modular connector standards.

The transmission properties of these connectors usually vary depending upon the printed circuit board (PCB) impedance and other components utilized in the active networking equipment printed wiring boards. For these reasons the transmission properties, while being critical for the equipment functionality, are not covered by U.S. or international standards, but are defined by each equipment manufacturer based on its own system experimental evaluation.

Network interface connectors require designers to address and solve a combination of unique transmission parameters as well as other limitations common to modular connectors. These include:

- Low profile,
- Variable transmission parameters to be tuned from one application to another. The major transmission parameters are:
  - Near End Cross Talk (NEXT),
  - Return Loss, and
  - Common Mode Noise,
- Completely self-contained compensation for e.g., NEXT, return loss, and common mode noise and
- Multiport or single port, shielded or unshielded with condition - indicating light emitting diodes (LEDs).

Network equipment providers market a large variety of appliances for 10/100 MbE, 1 GbE and 10 GbE. Network interface connectors are integral parts of these appliances. The application market requires both single port and multiport connectors. The connectors are soldered to multi-layer motherboards together with other components such as PHY, resistors, magnetics, capacitors, etc.

Moreover, network applications require smaller and denser designs because, in part, the motherboard PCBs are multilayer and expensive.

Conventional techniques for enhancing the transmission performance of connectors on a motherboard PCB can be very costly. An RJ45 standard connector is often the tallest component on the PCB—so its height over the PCB needs to be reduced without sacrificing the standard dimensions.

While the outline and dimensions of modular connectors are subject to U.S. and international standards such as IEC 600603-7 and TIA 568 series, the internal designs of connectors differ widely.

The desired transmission properties of these connectors usually vary depending upon the Physical Layer (PHY) input impedance and other components utilized in the active networking equipment printed wiring boards.

Typical transmission requirements commonly referred to as categories (category 5e is characterized up to 100 MHz, category 6 up to 250 MHz and category 6a up to 500 MHz) are used as guidelines only.

The networking companies must have connectors of the same physical dimensions but be able to accommodate any one of a variety of options in transmission response. Moreover, the electrical response should differentiate for various transmission speeds. It is desirable for connectors, of identical appearance and footprint, provide matched electrical response for 10/100 Mbe, 1 GbE or 10 GbE chipsets. Presently, connectors are designed for specific issues such as a given common mode noise at a given frequency for a specific PHY.

The performance of a connector is judged by either direct measurement of the transmitted signals or by controlling the major transmission parameters such as NEXT, Return loss and Common mode noise and Common to Differential mode conversion. These parameters are specified in the US in TIA 568-10 and internationally in the IEC 60603-7 standard series.

Low profile RJ45 connectors are known and are used as network interface connectors. Their interface geometry is still governed by the TIA 568 and IEC/ISO 60603-7 series of standards. However network interface connectors are not parts of the channel as defined by the standards.

Since the location of the PHY and/or other components in the channel, such as magnetics (filters and isolation transformers) and discharge capacitors, distorts the NEXT and Return Loss (RL), the requirements for NEXT and RL compensation differ from application to application. In order to meet such requirements connector manufacturers supply different connectors to work with specific PHYs.

The transmission performance of RJ45 type network interface connectors is enhanced by internal compensation such as by providing compensation circuitry on an internal PCB or on flexible circuits. The connector contacts are soldered to the internal PCBs.

Presently, it is not feasible to enhance or modify the transmission characteristics of such connectors after they are soldered to the motherboard.

Tests of connectors are conducted using the exact network equipment and PHY specific to the application. In order to tune the performance for a particular application, connectors have to be de-soldered and removed from the motherboards, re-assembled or discarded and new connectors used. If a problem is found in the field, often the complete network installation has to be re-placed or scrapped.

It would be advantageous to be able to modify, upgrade or change the transmission characteristics and performance of a network interface connector after it has been soldered to a motherboard.

SUMMARY OF INVENTION

Accordingly, it is an object of the present invention to provide a new and improved network interface connector, the electrical properties and transmission characteristics of which can be easily modified, upgraded or changed.

It is another object of the present invention to provide such a new and improved network interface connector, the electrical properties and transmission characteristics of which can be easily modified, upgraded or changed after it has been soldered to a motherboard.

Still another object of the present invention is to provide such a new and improved network interface connector of the modular type whose mateable interface geometry conforms with modular connector standards.

Still another object of the present invention is to provide such a new and improved network interface connector which has a single port or multiple ports.

Still another object of the present invention is to provide such a new and improved network interface modular connector for applications for at least 1 GbE.

Still another object of the present invention is to provide such a new and improved network interface modular connector which has a low profile and which can be mounted mid-board.

Still another object of the present invention is to provide such a new and improved network interface modular connector the components of which are easy to manufacture at low cost using conventional methods and equipment.

Still another object of the present invention is to provide such a new and improved network interface connector the transmission enhancements of which, such as compensation, are situated within the connector.

Still another object of the present invention is to provide such a new and improved network interface connector which meets selected specified requirements when tested as specified in TIA 568A and IEC 60603-7.

Still another object of the present invention is to provide such a new and improved network interface connector which can be customized to a high degree to differentiate from 1 GbE to other limits specified by customers.

Still another object of the present invention is to provide such a new and improved network interface connector which can be shielded or unshielded and can be provided with condition-indicating LEDs.

Briefly, these and other objects are attained by providing a network interface connector comprising an outer housing and a contact assembly situated in the outer housing. The contact assembly includes a mounting block, a first group of first or upper elongate contacts mounted on the mounting block and a second group of second or lower elongate contacts mounted on the mounting block. The first and second elongate contacts are configured such that contact portions of the first and second contacts are coplanar and spaced according to U.S. and international standards for modular connectors. The first and second elongate contacts have rearward portions that are situated in first and second spaced parallel planes respectively to define a proximity gap between them. A proximity insert is situated, preferably removably, in the proximity gap between the rearward portions of the first and second elongate contacts.

The proximity insert preferably extends between the rearward portions of all of the first and second contacts.

The construction of the proximity insert is chosen in view of the desired transmission and electrical properties of the connector. For example, the proximity insert can be constituted by a printed circuit board having conductors coupled to the elongate contacts. The proximity insert can be formed of a non-conductive material or of a material having a high dielectric constant, such as BaTio2 or ceramics. Alternatively, the proximity insert can be formed of a metallic material coated with an isolating material such as polymide, polybutylene terephthalate (PBT) or acrylic paint, or be formed of ferrite.

The contact portions of the first and second contacts preferably alternate with one another. The first and second groups of elongate contacts preferably include four first elongate contacts and four second elongate contacts. At least one pair of first and second elongate contacts cross over each other.

The connector either has a single port or multiple ports. In a multiple port embodiment a contact assembly is associated with each port. The contact assemblies are configured such that the proximity gaps of the contact assemblies are aligned with each other and single proximity insert is configured to be situated, preferably removably, in aligned proximity gaps.

DETAILED DESCRIPTION OF THE DRAWINGS

A more complete appreciation of the present invention and many of the attendant advantages thereof will be readily understood by reference to the accompanying drawings which illustrate preferred embodiments of the invention wherein.

Figure 10:
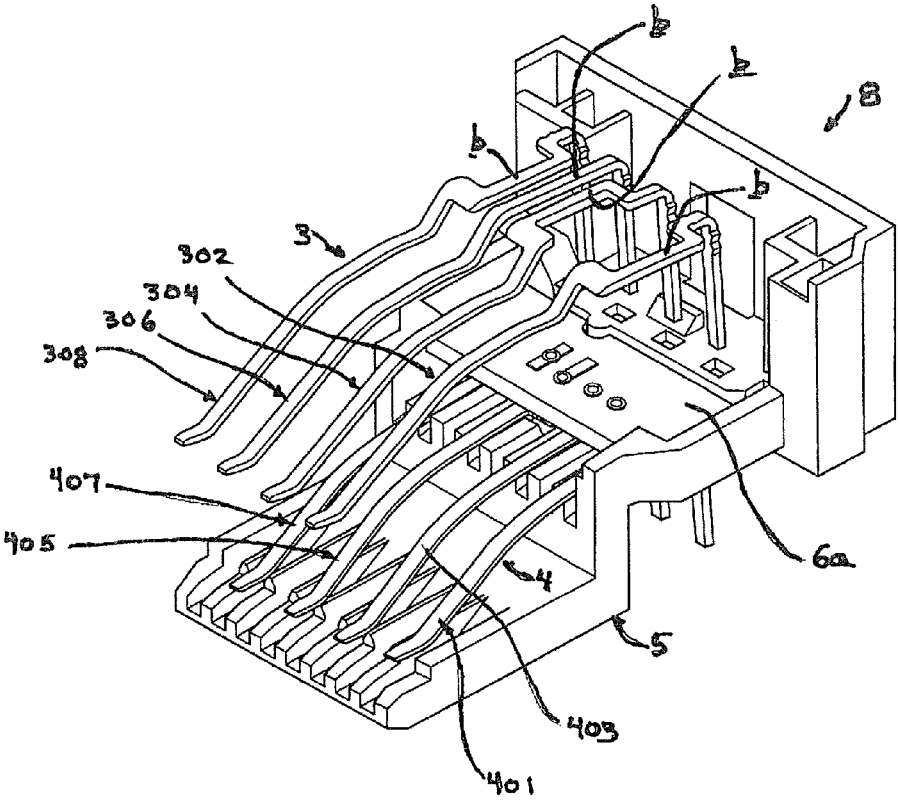
FIG. 10 is a perspective view similar to FIG. 6 showing a proximity insert comprising a printed circuit board.
Figure 11:
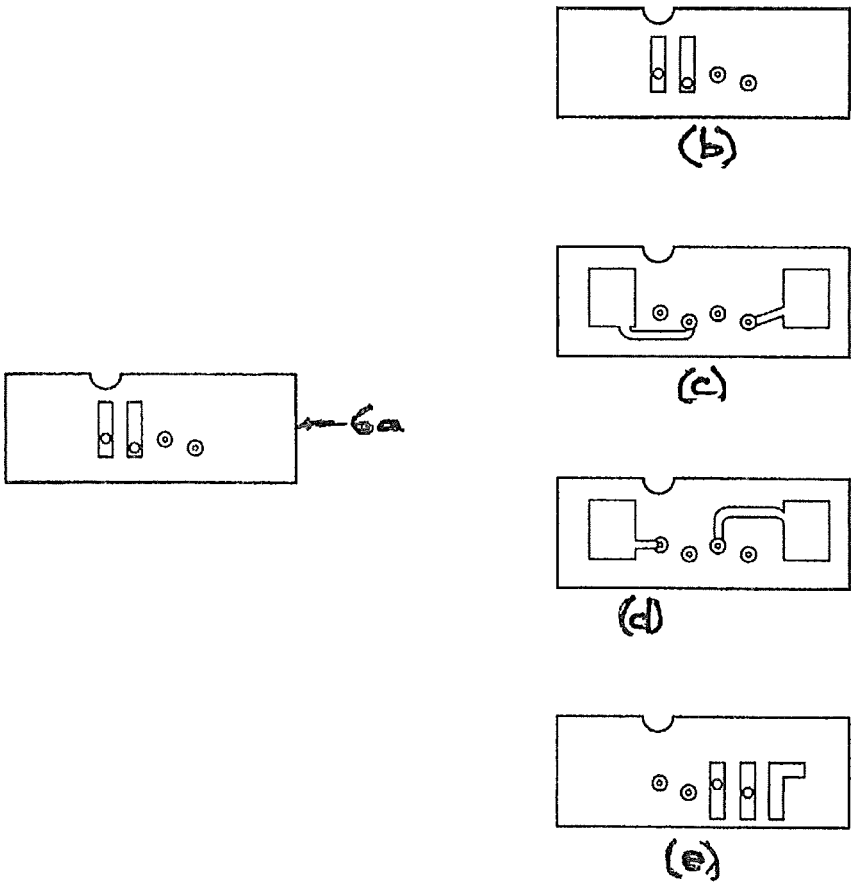
Figure 12:
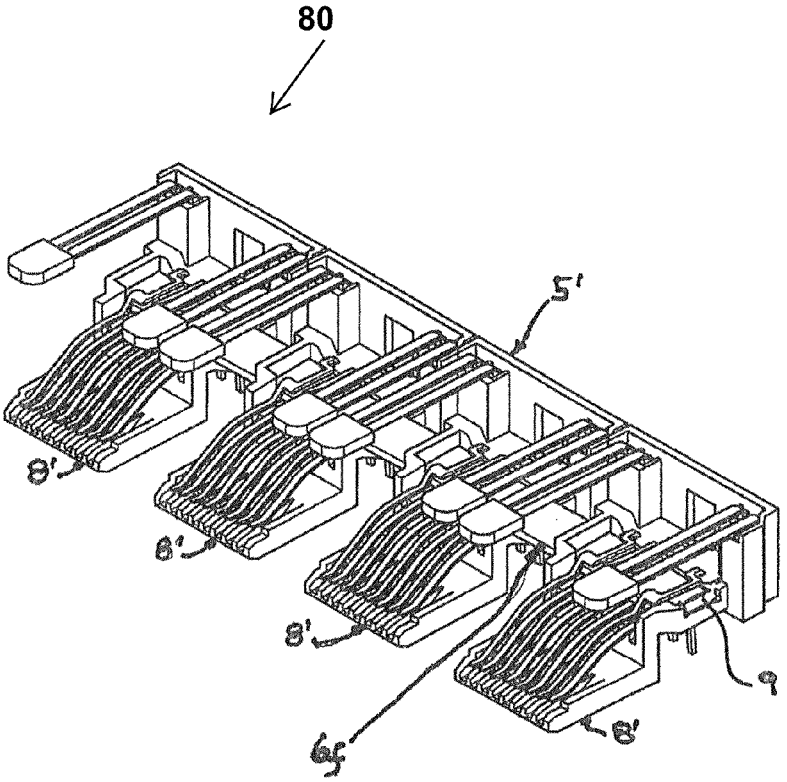
Figure 13:
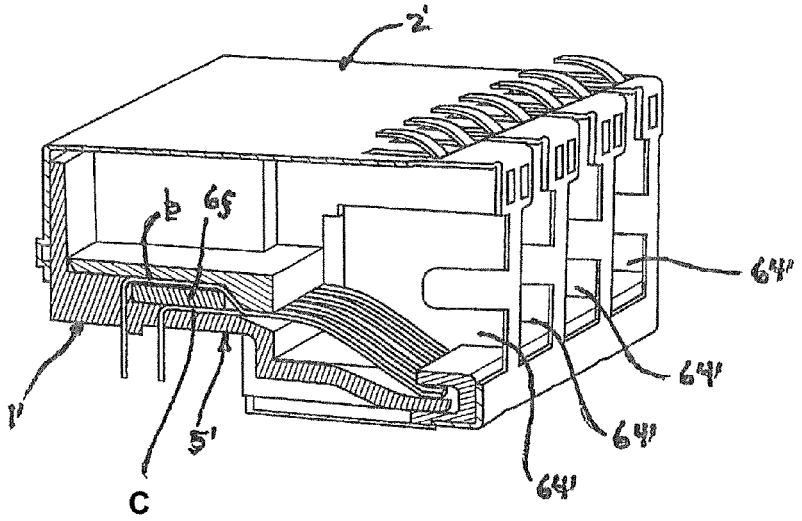
Figure 14:
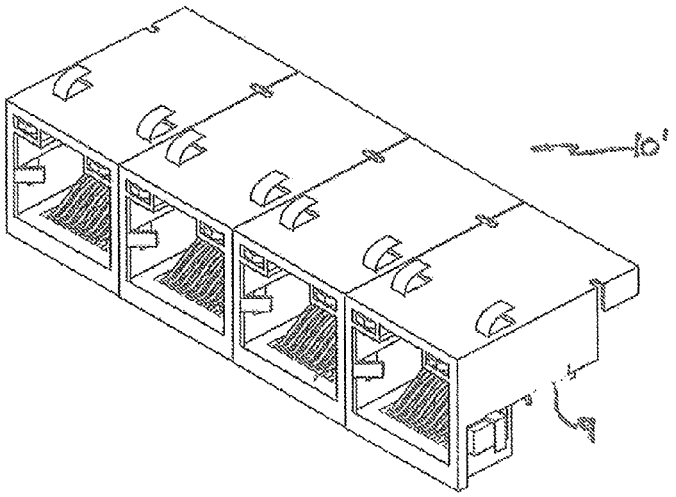
Figure 15:
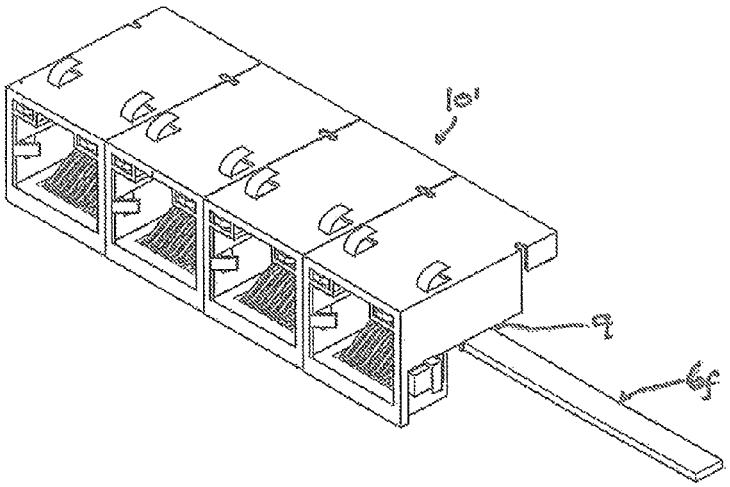
Figure 16:
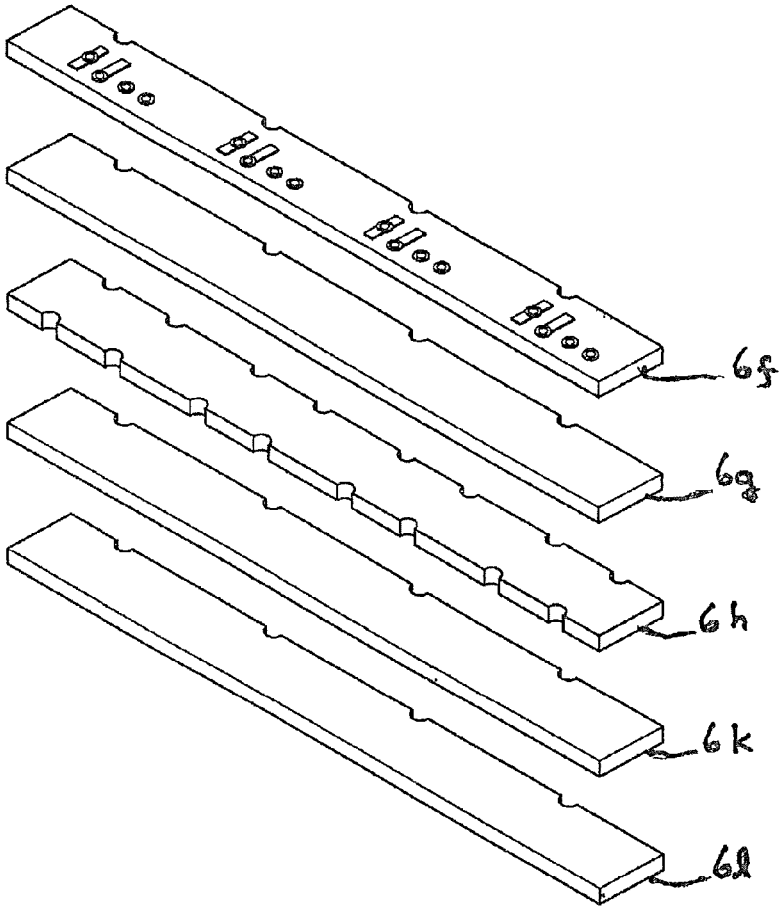
Figure 17:
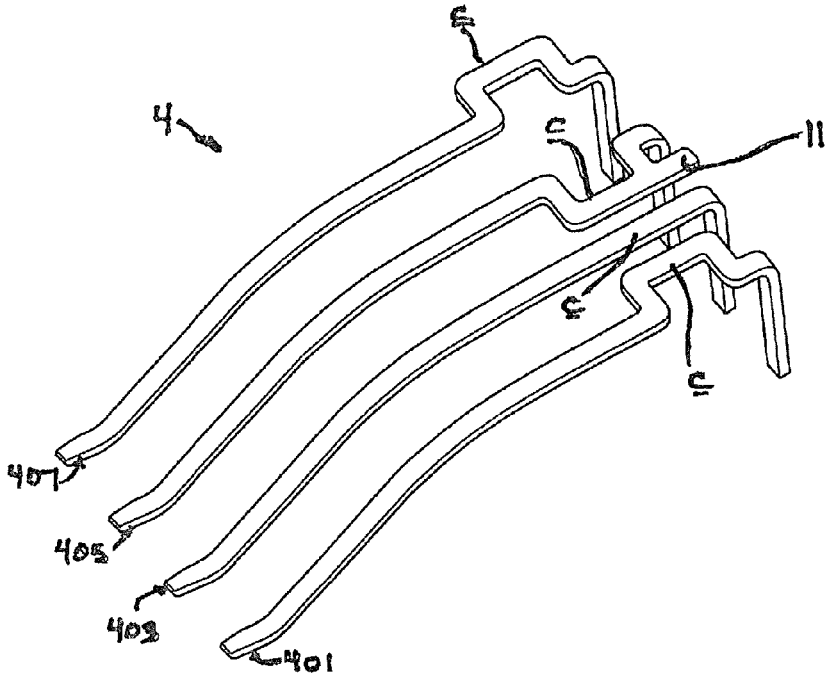
Figure 18A:
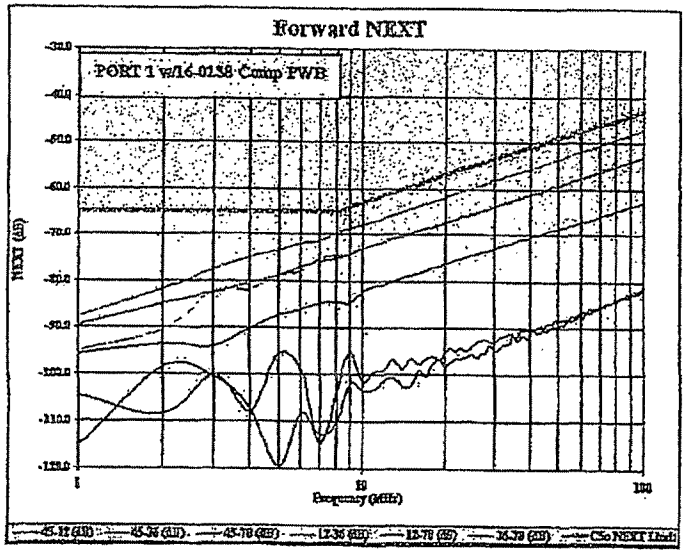
Figure 18B:
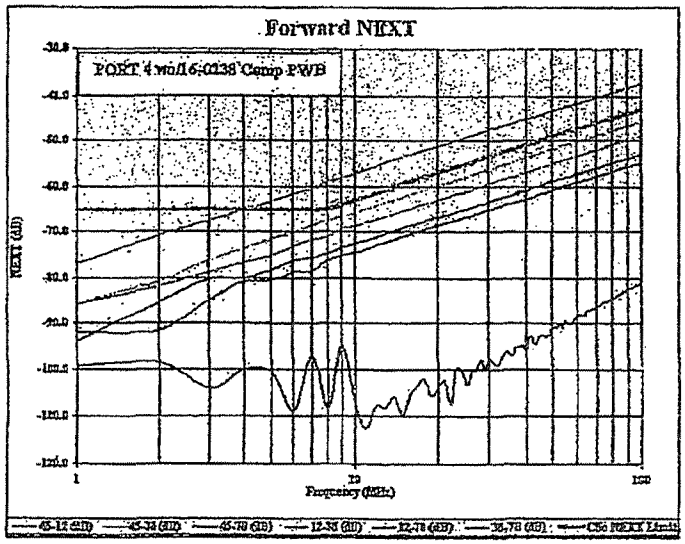

FIGS. 11(*a*)-(*e*) are plan views showing the proximity insert of FIG. 10 and the various layers constituting the printed circuit board;

FIG. 12 is a perspective view of a contact assembly of a preferred embodiment of a multi-port network interface connector according to the present invention;

FIG. 13 is a perspective view in section of a multi-port network interface connector in accordance with the present invention;

FIG. 14 is a perspective view of the multi-port network interface connector shown in FIG. 13 and showing a slot for receiving a proximity insert;

FIG. 15 is a perspective view of the multi-port network interface connector shown in FIGS. 13 and 14 and showing a proximity insert being received in the slot shown in FIG. 14;

FIG. 16 is a perspective view showing a group of various embodiments of proximity inserts for use in a multi-port network interface connector according to the present invention;

FIG. 17 is a perspective view of elongate contacts of a lower contact array showing a capacitive adjustment feature; and FIG. 18(*a*) and FIG. 18(*b*) are graphs plotting electrical responses of the same connector incorporating different proximity inserts.

DESCRIPTION OF PREFERRED EMBODIMENTS

Figure 1A:
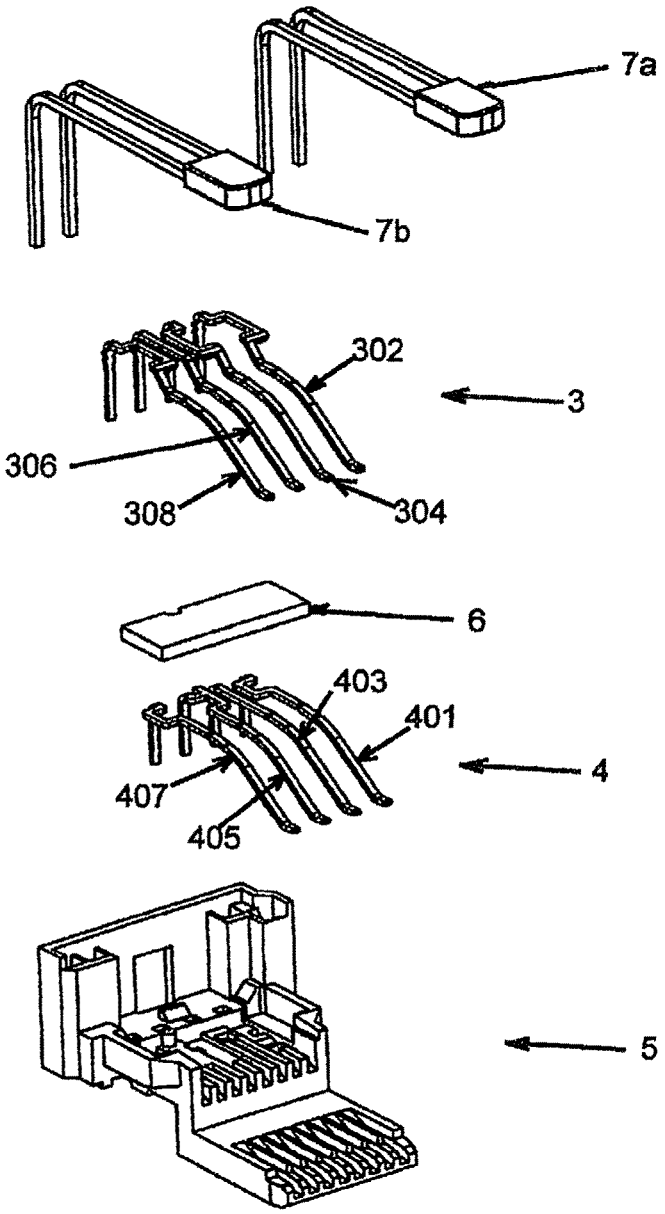
FIG. 1A is an exploded perspective view showing the components of a contact assembly, namely upper and lower contact arrays, a mounting block, a proximity insert and optional LEDs, of a preferred embodiment of a network interface connector according to the present invention.
Figure 1B:
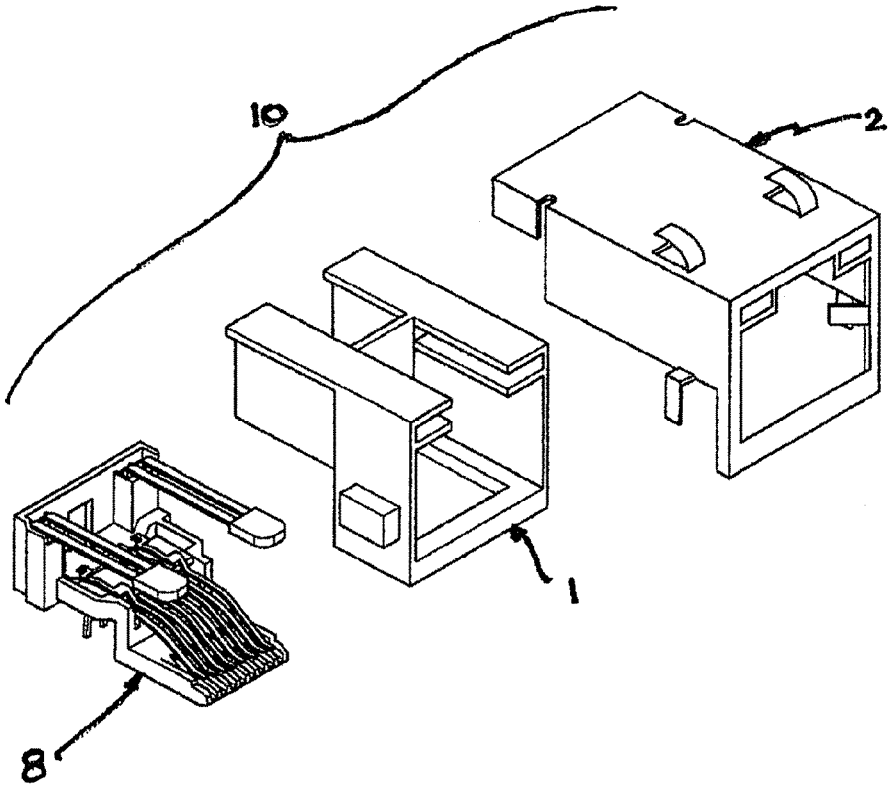
FIG. 1B is an exploded perspective view showing the assembled contact assembly, outer housing and shield of a network interface connector according to the invention.

Referring now to the drawings in which like reference characters designate identical or corresponding parts throughout the several views and, more particularly to Figs. 1*a* and 1*b*, the components of a modular network interface connector, generally designated 10 (shown assembled in FIG. 8), are illustrated in exploded views. The components include an outer housing 1 and a contact assembly, generally designated 8. The contact assembly 8 includes an upper or first contact array 3 comprising four first elongate contacts 302, 304, 306 and 308 (FIG. 2), a lower or second contact array 4 comprising four second elongate contacts 401, 403, 405 and 407 (FIG. 2), a mounting block 5 on which the first and second contacts of the upper and lower contact arrays 3 and 4 are mounted and a proximity insert 6 situated between rearward portions of the first and second contacts.

According to the invention, a variety of different proximity inserts are possible for use in particular applications to achieve desired electrical properties and improved transmission characteristics.

As described below, the contact assembly 8 is assembled and situated within the outer housing 1. A metallic shield 2 is optionally provided around housing 1 for use in a shielded system as is conventional. A pair of conditioning-indicating LEDs 7*a* and 7*b* and leads are optionally provided.

Figure 2:
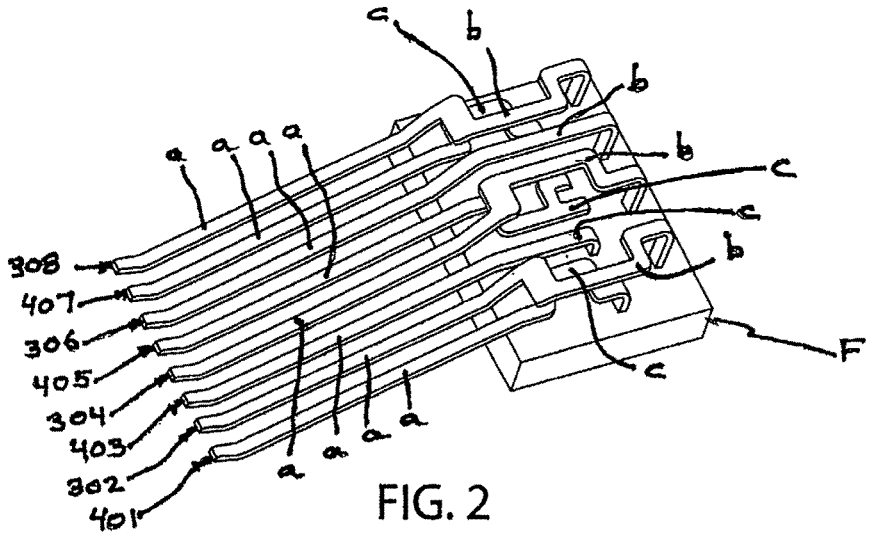
FIG. 2 is a perspective view showing the operative positions of the elongate contacts of upper and lower contact arrays of the contact assembly of FIG. 1 (mounted in a fixture for illustrative purposes)
Figure 3:
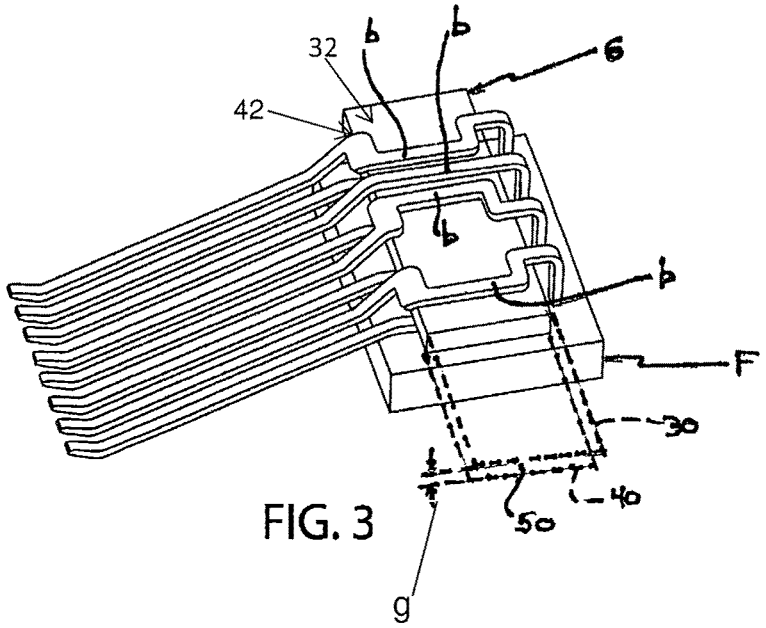
FIG. 3 is a view similar to FIG. 2 showing a proximity insert of the contact assembly situated in a proximity gap defined between rearward portions of the contacts of the upper and lower contact arrays respectively.

Referring to FIG. 2, the configuration of the elongate contacts when mounted on the mounting block 5 (not shown in FIG. 2) is illustrated. A fixture F is shown for illustrative purposes and does not comprise a part of the connector. The first elongate contacts 302, 304, 306 and 308 of the upper contact array 3 each have a forward contact portion a and a rearward portion b, and the second elongate contacts 401, 403, 405 and 407 of the lower contact array 4 each have a forward contact portion a and a rearward portion c. The first and second elongate contacts are configured such that, when mounted on the contact mounting block 5 (not shown in FIG. 2), the forward contact portions a of the first and second elongate contacts 401, 302, 403, 304, 405, 306, 407 and 308 are coplanar, the rearward portions b of the first elongate contacts 302, 304, 306 and 308 are coplanar, situated in a first plane 30 (FIG. 3), and the rearward portions c of the second elongate contacts 401, 403, 405 and 407 are coplanar, situated in a second plane 40 (FIG. 3) which is parallel to and spaced from the first plane by a distance g which defines a proximity gap 50 (FIG. 3). A pin portion d extends downwardly from the rearward end of each of the rearward portions b and c of the first and second contacts of arrays 3 and 4. The dimensions and spacing of the forward contact portions a of the first and second contacts conform to U.S. and international standards for modular connectors.

The proximity insert 6 preferably comprises a body having the shape of a thin rectangular prism having opposed parallel upper and lower faces 32, 42, although other shapes are possible. The thickness of the proximity insert 6, i.e., the distance between the upper and lower surfaces 32 and 42 of the proximity insert 6, is substantially equal to or slightly smaller than the distance g of the proximity gap 50 and is within the range of between about 0.01" to 0.2". The proximity insert 6 is situated in the proximity gap 50 as shown in FIG. 3. The rearward portions b and c of the first and second elongate contacts of the contact arrays 3 and 4 may engage or may be slightly spaced from the opposed surfaces 32, 42 of the proximity insert 6 depending on the application.

Figure 4:
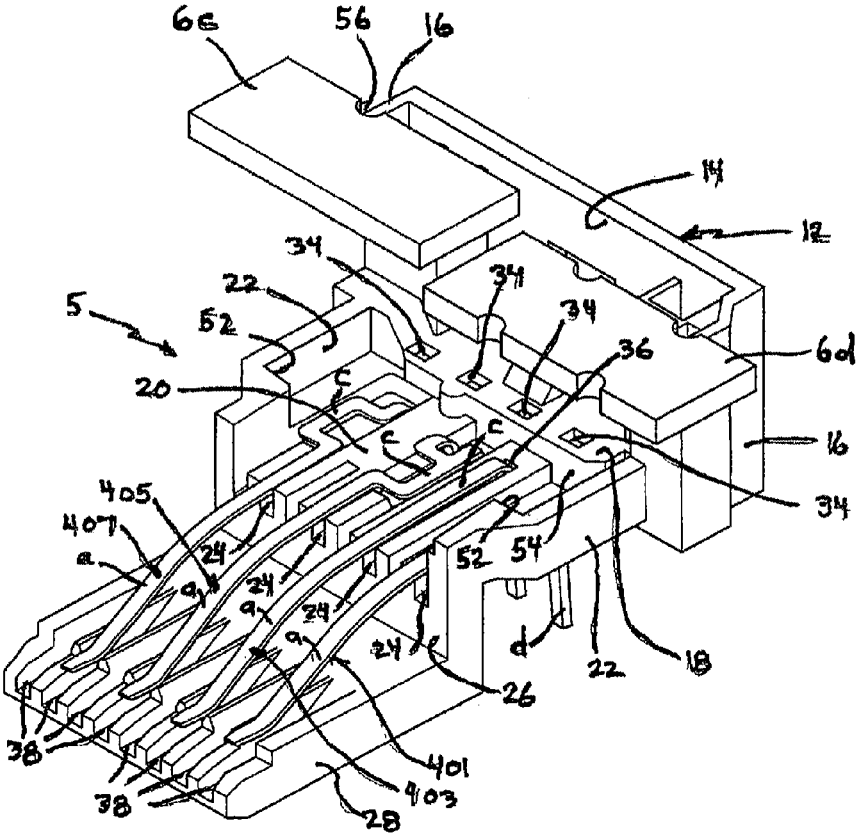
FIG. 4 is a perspective view showing components of the contact assembly shown in FIG. 1 including a mounting block, contacts of the lower contact array mounted on the mounting block and two proximity inserts which are alternatively positioned for mounting on the mounting block over rearward portions of the contacts of the lower contact array.
Figure 5:
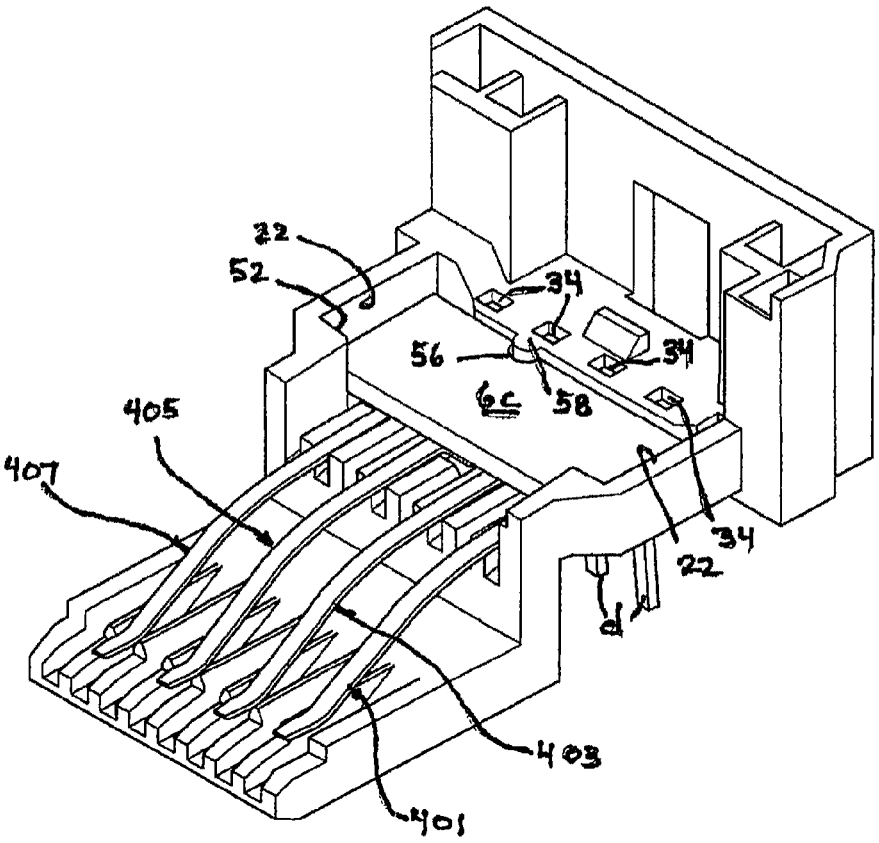
FIG. 5 is a perspective view showing components of the contact assembly shown in FIG. 1 including a mounting block, contacts of the lower contact array mounted on the mounting block and a proximity insert mounted over rearward portions of the contacts of the lower contact array.

Referring to FIGS. 4 and 5, the contact mounting block 5 is formed of an insulative material, e.g., plastic, and includes a rear framework 12 having a transverse vertical rear wall 14 and a pair of longitudinally extending vertical side walls 16. An upper horizontal shelf 18 extends forwardly from the framework 12 and a lower horizontal shelf 20 extends forwardly from the upper shelf 18. Another pair of vertical side walls 22 extend upwardly from the transverse ends of lower shelf 20. Four longitudinal recesses 24 are formed in the lower shelf 20, which open onto the forward vertical surface of a vertical transverse wall 26 depending downwardly from the forward end of the lower shelf 20. A horizontal wall 28 extends forwardly from the lower end of vertical transverse wall 26. Four transversely spaced vertical through-holes 34 open onto the horizontal shelf 18 and four transversely spaced vertical through-holes 36 open onto the lower horizontal shelf 20. Through-holes 34 and 36 are situated in alternating longitudinal alignment. Eight longitudinal guide recesses 38 are formed at the forward end region of the horizontal wall 28.

The second elongate contacts 401, 403, 405 and 407 of the lower contact array 4 are mounted on the mounting block 5 by inserting their pin portions d through the holes 36 of the lower shelf 20. The rearward portions c of the second elongate contacts 401, 403, 405 and 407 are received in respective ones of the recesses 24 formed in the lower horizontal shelf 20. The second elongate contacts 401, 403, 405 and 407 have rectangular cross-sections and the upper surfaces of the rearward portions c are substantially coplanar with, or slightly recessed from, the upper surface of shelf 20. The forward contact portions a of the second elongate contacts 401, 403, 405 and 407 slant downwardly from the forward ends of the recesses 24 of lower horizontal shelf 20 and are coplanar with each other. The forward ends of the forward contact portions a of the second elongate contacts 401, 403, 405 and 407 are situated in the first, third, fifth and seventh guide recesses 38 (as seen from the right side of the contact mounting block 5 in FIG. 4).

Still referring to FIGS. 4 and 5, a proximity insert 6*c*, having a construction designed to provide certain electrical characteristics as described below, is situated over the rearward portions c of the second elongate contacts 401, 403, 405 and 407 so that its lower surface contiguously overlies the rearward portions c. (Two proximity inserts 6*c* and 6*d* are shown in FIG. 4 to indicate that a particular proximity insert can be selected from different possible constructions to provide particular electric characteristics to achieve desired transmission properties.) The proximity insert 6*c* is bounded on its sides by the vertical side walls 22 of mounting block 5. A pair of rearward facing vertical shoulders 52 and a forward facing vertical wall 54 extending between the upper and lower horizontal shelves 18 and 20 bound the forward and rearward surfaces of proximity insert 6*c*. As seen in FIG. 5, the upper surface of proximity insert 6*c* is substantially coplanar with the upper horizontal shelf 18. A notch 5*b* is formed in the rear surface of the proximity insert 6*c* closer to one of its sides than the other and a corresponding protuberance 58 extends from the forward facing wall 54 which assures proper orientation of the proximity insert 6*c* on the mounting block 5.

The thickness of the proximity insert 6*c* is substantially equal to the size g of the proximity gap 50 (FIG. 3) which is substantially equal to the distance between the upper and lower horizontal shelves 18 and 20.

Figure 6:
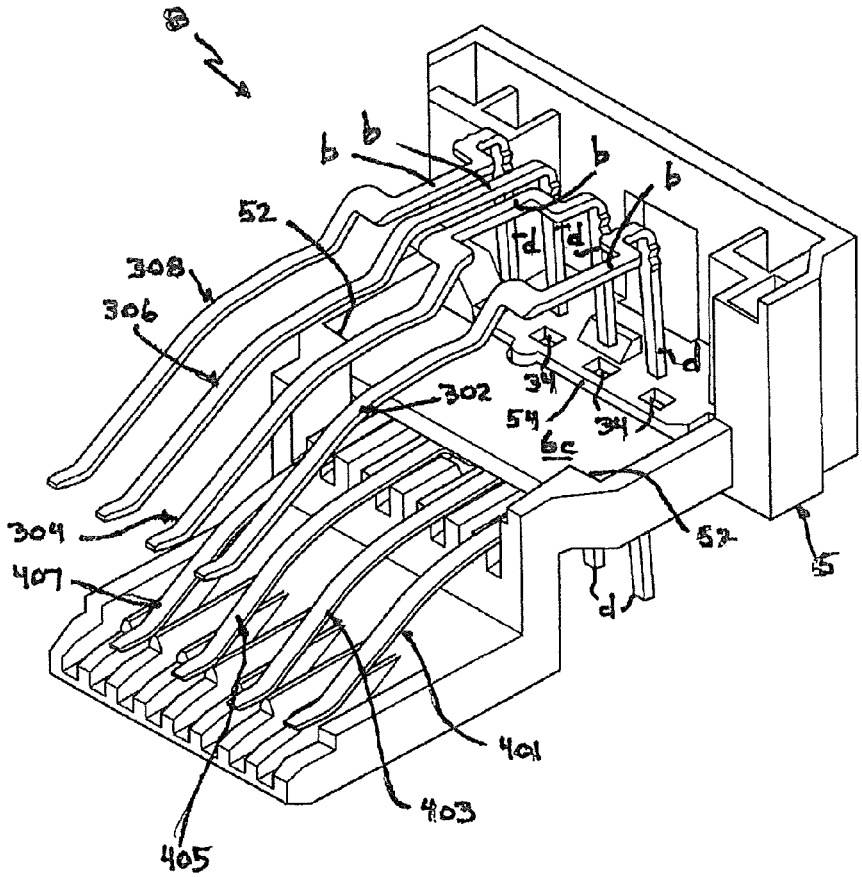
FIG. 6 is a perspective view similar to FIG. 5 showing the contacts of the upper contact array positioned for mounting on the mounting block.
Figure 7:
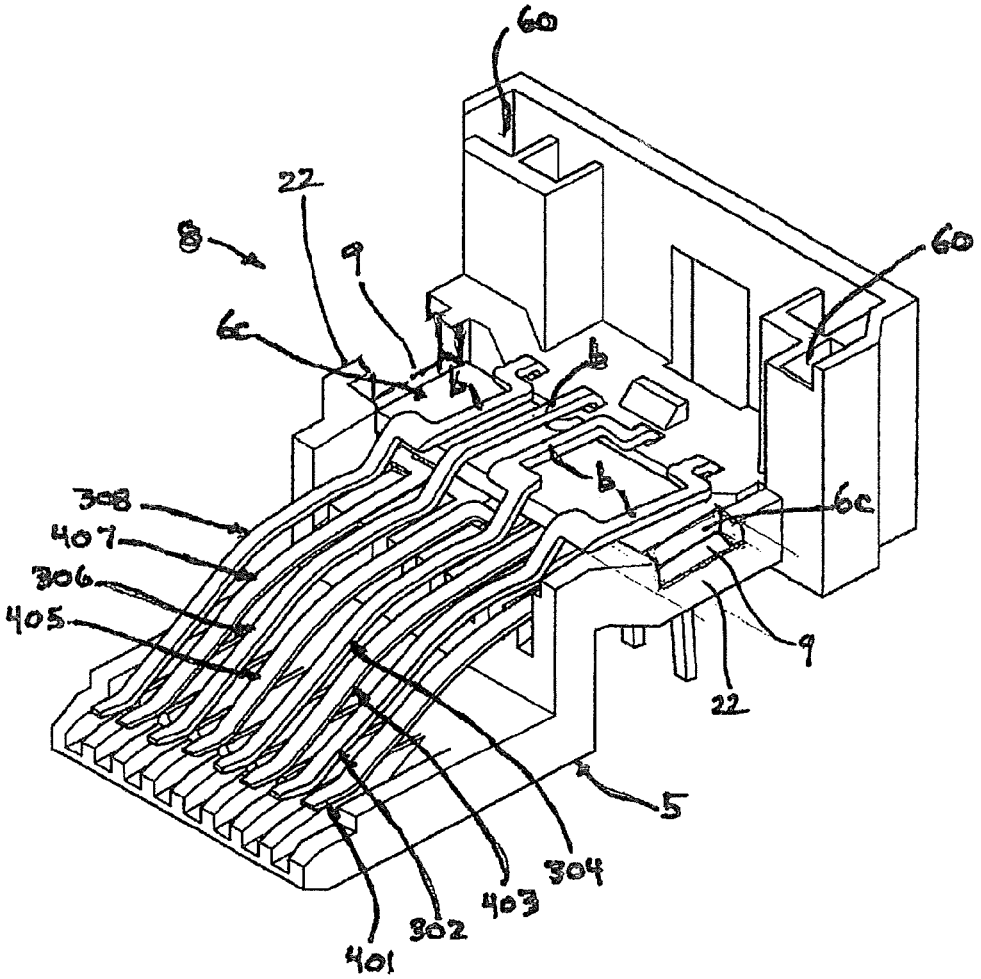
FIG. 7 is a perspective view of the assembled contact assembly shown in FIG. 1 showing the contacts of the upper contact array mounted on the mounting block, the rearward portions of the contacts of the upper contact array situated over the proximity insert.

Referring to FIGS. 6 and 7, the first elongate contacts 302, 304, 306 and 308 of the upper contact array 3 are then mounted on the contact mounting block 5 (on which the second elongate contacts 401, 403, 405 and 407, and proximity insert 6*c*, are already mounted) by inserting their pin potions d through the holes 34 in the upper shelf 18. The rearward portions b of the first elongate contacts 302, 304, 306 and 308 contiguously overlie the upper surface of proximity insert 6*c*. The forward contact portions a of the first elongate contacts 302, 304, 306 and 308 slant downwardly from the upper horizontal shelf and are coplanar with each other and with the forward contact portions a of the second elongate contacts 401, 403, 405 and 407. The forward ends of the contact portions a of the first contacts 302, 304, 306 and 308 are situated in the second, fourth, sixth and eighth guide recesses 38, i.e., alternating in position with the forward contact portions a of the second elongate contacts 401, 403, 405 and 407.

As mentioned above, the rearward portions b, c of the first and second elongate contacts of the first and second contact arrays 3 and 4 may engage or may be slightly spaced from the respective opposite surfaces of proximity insert 6 depending on the application. The proximity insert 6 is not soldered to any of the contacts. The assembly of first and second contacts of the upper and lower contact arrays 3 and 4 and the proximity insert 6*c* onto the mounting block 5 (as shown in FIG. 7) constitutes the contact assembly 8.

An advantage of the construction of the present invention is that the proximity insert is removable from the proximity gap after the connector has been soldered to a motherboard and replaceable by another proximity insert having different electrical characteristics to provide the connector with different transmission properties without de-soldering the connector from the motherboard. Referring to FIG. 7, in order to facilitate such replacement, slots 9 (shown only in FIG. 7) are formed in the side walls 22 aligned with the ends of the proximity insert 6*c*. When replacement with a different proximity insert is desired, the new insert is introduced through one of the slots 9 and inserted into the proximity gap. At the same time, the old insert is pushed out of the opposite slot 9. Appropriate openings are provided in the outer housing and shield. In this manner, the connector can be tuned for a particular application in the field without the need for de-soldering or replacement of the network installation.

Figure 8:
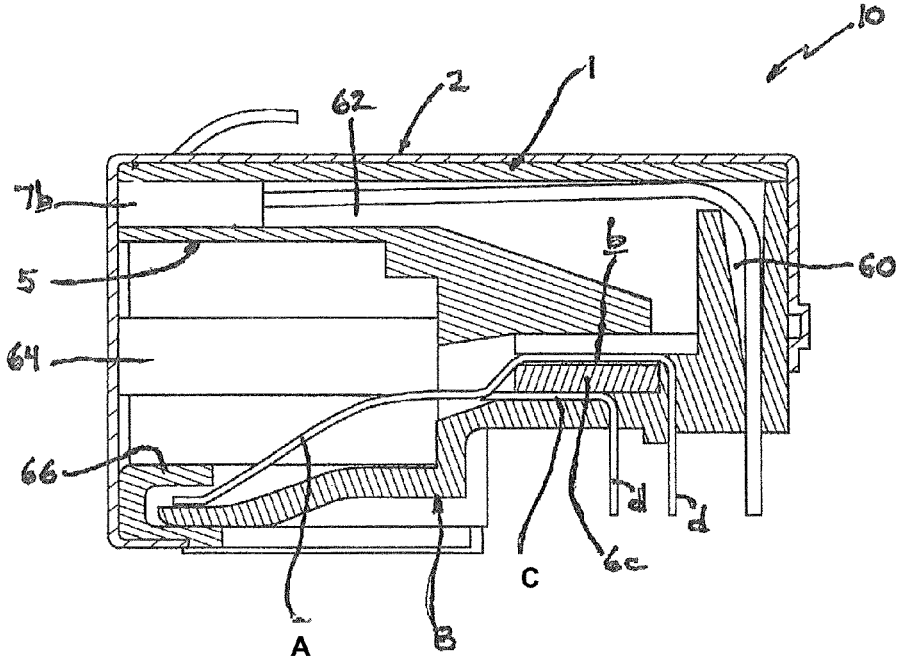
FIG. 8 is a side section view of a modular network interface connector according to the present invention.

Referring to FIG. 8, the contact assembly 8 is inserted into the outer housing 1 through its open rear side to complete the network interface connector 10. The leads of LEDs 7*a* and 7*b* are situated in vertical passages 60 formed in the rear framework 12 of the mounting block and bend forwardly so that the LEDs are situated at the front ends of respective horizontal passages 62. Metallic shield 2 is provided around the outer housing 1 as is conventional. A single port 64 is provided opening onto the front of connector 10 to receive a modular plug connector having contacts situated to engage the forward contact portions a of the first and second elongate contacts. The outer housing 1 has a rearwardly extending lip 66 formed along the lower side of the front of port 64 to capture the free ends of the forward contact portions a of the first and second elongate contacts.

Figure 9:
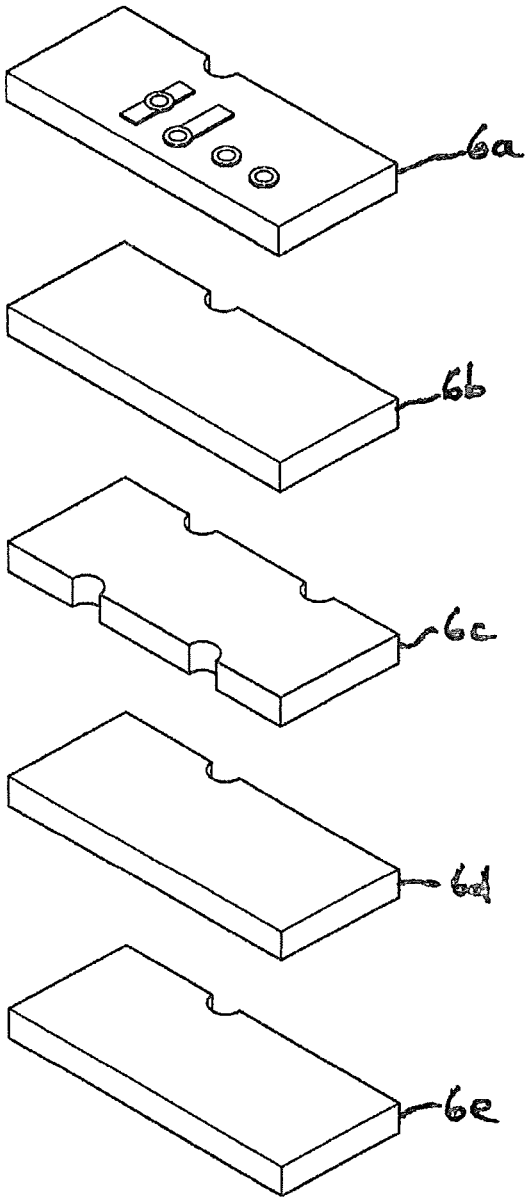
FIG. 9 is a perspective view showing a group of various embodiments of proximity inserts according to the present invention.

Five possible proximity inserts 6*a*-6*e* which can alternatively be interchangeably incorporated as part of a single port connector 10 to achieve desired electrical characteristics in accordance with the invention are illustrated in FIG. 9.

Proximity insert 6*a* comprises a printed circuit board made of modified epoxy resin in which metal conductors are embedded. This embodiment is discussed in greater detail below in connection with FIGS. 10 and 11.

Proximity insert 6*b* is formed of a non-conductive material having a low dielectric constant in a range of between about 1.1 to 3.7, such as plastic or paper or Polvtetrafluoroethylene (PTFE). This type of proximity insert prevents the rearward contact portions b and c from engaging each other when the proximity gap is small and provides necessary isolation for high voltages. Due to safety requirements, the connectors 10 must withstand 1000 volts between contacts. A proximity insert formed of high dielectric strength has better electrical performance than air. formed of high dielectric strength has better electrical performance than air.

Proximity insert 6*c* is formed of a material having a relatively high dielectric strength such as BaTiO2 or a ceramic material. The proximity insert 6*c* increases coupling and correspondingly increases the differential Near End Crosstalk between contacts 302 and 401 which may be of opposite phase to the crosstalk at a different part of a complete transmission line, i.e., in the modular plug. As a result, overall crosstalk will be reduced.

Proximity insert 6*d* is formed of metal covered on both its upper and lower surfaces with isolating material such as polyimide or PBT or acrylic paint. Such construction reduces impedance possibly to the characteristic impedance of the line in the immediate vicinity of PHY resulting in better balance and corresponding better Return Loss.

Proximity insert 6*e* is formed of ferrite material so as to comprise a low pass filter attenuating unwanted parasitic common and differential noise as well as attenuating some of the high frequency portion of the signal spectra, resulting in higher fidelity and improvements in noise to signal ratios.

FIG. 10 illustrates the assembly of the first upper contacts to the mounting block 5 subsequent to the mounting of the second lower contacts and a PCB type proximity insert 6*a* onto the mounting block 5. The proximity insert 6*a* contains a capacitive pattern that provides compensation for Near End Cross Talk. The proximity insert 6*a* is formed of four layers including a top layer (FIG. 11*b*), a mid-top layer (FIG. 11*c*), a mid-bottom layer (FIG. 11*d*) and a bottom layer (FIG. 11*e*). The PCB connects or is located in close proximity to the rearward portions b of upper contacts 302, 306 and to the rearward portions c of lower contacts 403 and 405. Additional conductor patterns of the PCB can be provided to increase or reduce the characteristic impedance providing a better match to the dominant impedance of the PHY and thus reducing the reflections and therefore improving Return Loss.

While the illustrated embodiments of the proximity inserts fill the proximity gap between the rearward portions of all of the contacts of the upper and lower arrays, the length of the proximity inserts can be shorter and fill the proximity gap between only some of the contacts and still achieve improved transmission properties.

Referring to FIGS. 12-15, a multiport (four ports) embodiment of a network interface connector according to the invention, designated 10', is shown. The multiport contact assembly 80 is shown in FIG. 12 and essentially constitutes a single elongated contact mounting block 5' having four spaced contact assemblies 8' each basically identical to the structure of the contact assembly 8 of the single port embodiment. The proximity gaps 50 of the four contact assemblies 8' are aligned with each other and a single elongated proximity insert 6' extends through the four proximity gaps. As shown in FIG. 16, a variety of such elongated proximity inserts, such as inserts 6*f*-6*l*, are provided having the same constructions as proximity inserts 6*a*-6*e* described above.

The multiport contact assembly 80 is situated in an appropriately formed multiport outer housing 1' which may be covered by a shield 2' as seen in FIG. 12.

As seen in FIGS. 12, 14 and 15, a slot 9 is provided at opposite ends of the mounting block 5' and outer housing in alignment with the proximity gaps 50. The proximity insert 6*f* can be situated into the proximity gaps 50 by inserting it through the slot 9. As the proximity insert is inserted through a slot 9 at one end of the housing 1, any previously situated proximity insert will be pushed out of the contact assembly 8 by the new proximity insert through the slot at the other end of the housing. Such a procedure can be effected even after the connector 10' is soldered to the motherboard.

Referring to FIG. 17, according to another aspect of the invention, a capacitive adjustment contact extension 11 is provided on a rearward portion c of at least one of the lower elongate contacts of the lower contact array 4, e.g., elongate contact 405. The contact extension 11 is not in the path of the signal and functions to allow alternative tuning of the transmission properties of the connector. The extension 11 is stamped using an optional die cutting tool. Several extensions 11 having varying lengths are possible. The extension cannot be seen by the user and does not affect the mechanical appearance or function of the connector. It does, however, provide a fine tune adjustment of transmission parameters.

FIG. 18(*a*) and FIG. 18(*b*) are graphical illustrations showing significant differences in the electrical responses, namely in Forward NEXT, when the same connector is used with inserts 6*a* and 6*b*.

Numerous modifications and variations of the illustrated preferred embodiments are possible in light of the above teachings within the scope of the claims appended hereto.

The invention claimed is:

1. A network interface connector, comprising:

an outer housing; and a contact assembly situated in said outer housing, said contact assembly including a mounting block, a first group of first elongate contacts mounted on said mounting block, said first elongate contacts each having a contact portion and a rearward portion, a second group of second elongate contacts mounted on said mounting block, said second elongate contacts each having a contact portion and a rearward portion, said first and second elongate contacts configured such that said contact portions of said first and second elongate contacts are coplanar and such that said rearward portions of said first and second elongate contacts are situated in first and second parallel spaced planes respectively to define a proximity gap between them, and a proximity insert situated in said proximity gap between said rearward portions of said first and second contacts, said proximity insert having desired electrical characteristics which provide the connector with certain transmission properties.

2. The network interface connector as recited in claim 1, wherein said proximity insert is removably situated in said proximity gap such that said proximity insert is removable from said proximity gap and replaceable by another proximity insert having different electrical characteristics to provide the connector with different transmission properties.

3. The network interface connector as recited in claim 2 wherein said proximity insert is removable from said proximity gap after the connector has been soldered to a motherboard and replaceable by another proximity insert without de-soldering the connector.

4. The network interface connector as recited in claim 3, wherein a pair of slots are formed in opposed sides of said mounting block in alignment with said proximity gap, said slots configured to enable said proximity insert to pass therethrough.

5. The network interface connector as recited in claim 1, wherein said proximity insert has the shape of a thin rectangular prism.

6. The network interface connector as recited in claim 5, wherein said proximity insert has a thickness in the range of between 0.01" to 0.1".

7. The network interface connector as recited in claim 1, wherein said proximity insert comprises a printed circuit board having conductors coupled to at least some of said elongate contacts.

8. The A network interface connector as recited in claim 1, wherein said proximity insert is formed of non-conductive material.

9. The network interface connector as recited in claim 1, wherein said proximity insert is formed of a high dielectric constant material.

10. The network interface connector as recited in claim 9, wherein said material comprises $BaTiO_2$.

11. The network interface connector as recited in claim 9, wherein said material comprises a ceramic.

12. The network interface connector as recited in claim 1, wherein said proximity insert is formed of a metallic material having surfaces coated with electrical isolating material capable of withstanding the application of 500 VDC for 60 seconds.

13. The network interface connector as recited in claim 12, wherein said isolating material comprises polyimide.

14. The network interface connector as recited in claim 12, wherein said isolating material comprises PBT.

15. The network interface connector as recited in claim 12, wherein said isolating material comprises acrylic paint.

16. The network interface connector as recited in claim 1, wherein said proximity insert is formed of ferrite.

17. The network interface connector as recited in claim 1, wherein said contact portions of said first elongate contacts alternate in position with said contact portions of said second elongate contacts.

18. The network interface connector as recited in claim 1, wherein said proximity insert is situated between the rearward portions of all of said first and second elongate contacts.

19. The network interface connector as recited in claim 1, wherein said rearward portions of at least one pair of first and second elongate contacts overlap each other.

20. The network interface connector as recited in claim 1, wherein said connector comprises a single port connector.

21. The network interface connector as recited in claim 1, wherein said connector comprises a multiport connector, and wherein said connector includes multiple contact assemblies, each contact assembly having a respective proximity gap.

22. The network interface connector as recited in claim 21, wherein said proximity gaps of said multiple contact assemblies are in aligned positions, and wherein said proximity insert is configured such that it extends through multiple aligned proximity gaps.

23. The network interface connector as recited in claim 22, wherein a pair of slots are formed in opposed sides of said mounting block in alignment with said proximity gaps, said slots configured to enable said proximity insert to pass therethrough.

24. The network interface connector as recited in claim 1, wherein said mounting block includes a first upper shelf and a second lower shelf, each of said first and second shelves having through-holes formed therein, and wherein said first and second elongate contacts include pin portions extending from said rearward portions, said pin portions of said first elongate contacts extending through said through-holes formed in said first upper shelf, and said pin portions of said second elongate contacts extending through said through-holes formed in said second lower shelf.

25. The network interface connector as recited in claim 1 wherein said proximity insert has a thickness substantially equal to or slightly smaller than the height of said proximity gap.

* * * * *